United States Patent [19]

Beavan

[11] 4,332,691

[45] Jun. 1, 1982

[54] BLEACHING LIQUID CLEANING COMPOSITION

[75] Inventor: Stuart W. Beavan, Merseyside, England

[73] Assignee: Lever Brothers Company, New York, N.Y.

[21] Appl. No.: 251,036

[22] Filed: Apr. 6, 1981

[30] Foreign Application Priority Data

Apr. 11, 1980 [GB] United Kingdom ..... 8012042
Apr. 11, 1980 [GB] United Kingdom ..... 8012046
Apr. 11, 1980 [GB] United Kingdom ..... 8012047
Apr. 11, 1980 [GB] United Kingdom ..... 8012048

[51] Int. Cl.[3] ..... C11D 9/42

[52] U.S. Cl. ..... 252/96; 252/100; 252/103; 8/108 A; 8/108 R; 8/103

[58] Field of Search ..... 252/96, 100, 103; 8/108 A, 108 R, 103

[56] References Cited

U.S. PATENT DOCUMENTS 3,547,573 12/1970 Tourdot et al. ..... 8/108
3,836,475 9/1974 Kirner ..... 8/108 X

FOREIGN PATENT DOCUMENTS 1137474 of 0000 United Kingdom .
1453383 of 0000 United Kingdom .
821168 9/1959 United Kingdom .
964728 7/1964 United Kingdom .
981645 1/1965 United Kingdom .
992952 5/1965 United Kingdom .
992953 5/1965 United Kingdom .
992954 5/1965 United Kingdom .
992954 5/1965 United Kingdom .
992955 5/1965 United Kingdom .
1071494 6/1967 United Kingdom .
1073165 6/1967 United Kingdom .
1121756 7/1968 United Kingdom .
1236710 6/1971 United Kingdom .
1266896 3/1972 United Kingdom .
1397595 6/1975 United Kingdom .
1402326 8/1975 United Kingdom .
2020331 11/1979 United Kingdom .

*Primary Examiner*—Mayer Weinblatt
*Attorney, Agent, or Firm*—Kurtz, Melvin H.

[57] ABSTRACT

A photobleaching liquid cleaning composition contains 1% to 79.9% by weight of detersive surfactant, with or without a detergency builder; 0.1 to 40% by weight of a chlorite, and at least about 20% by weight of a liquid base, the composition yielding a pH of at least 6 when dissolved in water at a concentration of about 0.5 g/l.

The composition is suitable for the laundering of fabrics as well as for the use in the manual cleaning of dishes or in general purpose cleaning of hard surfaces.

16 Claims, No Drawings

BLEACHING LIQUID CLEANING COMPOSITION

This invention relates to a bleaching liquid composition which is particularly suitable for the cleaning of fabrics as well as for use in the manual cleaning of dishes or in general purpose cleaning e.g. hard surface cleaning.

The convenience afforded by detergent compositions in liquid form in contrast to the conventional dry powder formulations has long been recognized and recently more interest in fabric washing liquids has been observed. Some of the advantages of liquid detergents include, for example, freedom of dust and clotting; ease of solubilization and ease of use, particularly in automatic dispensers and measuring devices found in a number of present day washing machines. Still, a number of problems have not completely been overcome, especially with respect to finding a suitable bleaching agent which is sufficiently stable in the aqueous medium.

It is known to include bleaches in cleaning products, in particular in detergent compositions for cleaning fabrics and hard surfaces for example. It is known for these bleaches to be photobleaches or to be bleaches activated by photosensitive bleach activators. For example U.S. Pat. No. 4,033,718 describes a detergent composition containing particular species of zinc phthalocyanine as an oxygen bleach activator.

It is also known to use alkali metal chlorites as a bleach. For example it is known to bleach cellulose with sodium chlorite in an acid medium, the chlorite in the acid medium producing chlorine dioxide which is the species responsible for the actual bleaching.

Acidic media are generally unsuitable for domestic cleaning processes. It is also known to activate chlorites at high pH with activators such as hydroxylammonium salts (see U.S. Pat. No. 3,836,475) but such activators are expensive and may also be toxic. For these reasons they have not found commercial success in domestic situations.

It is further known to use alkalimetal chlorites, particularly sodium chlorite, activated by high energy radiation for bleaching fabrics and other organic materials under alkaline conditions. British Pat. No. 1,397,595 discloses bleaching of fabrics using substantially high levels of chlorite in the bleaching liquor irradiated with high energy electron and $\gamma$-rays. These conditions are unsuitable for domestic use.

It is an object of the present invention to provide an effective and yet stable bleaching liquid cleaning composition usable particularly in the domestic cleaning of fabrics, which provides a bleaching effect at alkaline or neutral pH without the use of high cost chemical activators and without the use of such high energy electron and $\gamma$-rays.

Surprisingly it has been found that satisfactory bleaching, soil breakdown, stain removal and germ killing effect can be obtained using a liquid formulation containing a chlorite if the formulation and/or the substrate in contact therewith are irradiated with ultraviolet light. The present invention therefore provides a liquid cleaning formulation for carrying out such a method, e.g. in fabric washing, manual dishwashing or general purpose cleaning of hard surfaces. According to the invention there is provided a stable liquid-based bleaching composition, containing:

(i) from 1% to 79.9% by weight of detersive surfactant, with or without a detergency builder;

(ii) from 0.1%, to 40% by weight, preferably from 0.5 to 40% by weight of a chlorite; and (iii) at least about 20% by weight of a liquid base, the composition yielding a pH of at least 6.0 when dissolved in water at a concentration of about 0.5 g/l.

The liquid composition may be an isotropic liquid in which all the components are in solution, a structured liquid, an emulsion or an emulsion suspension. The isotropic composition may be unbuilt, containing a high level of detersive surfactant, or preferably built, i.e. containing a lower level of detersive surfactant together with a builder in an amount up to about 40% by weight and hydrotropes and structuring agents in minor amounts. The composition may be aqueous or non-aqueous. The liquid base may accordingly be water, an organic liquid, or mixtures thereof. Where more than 20% of a liquid detersive surfactant is used, it may be unnecessary to add any further liquid base. Built liquid cleaning compositions of the invention for washing fabrics will normally contain from 15–40% by weight of builders.

The detersive surfactant may be selected from one or more of anionic, nonionic, zwitterionic, amphoteric, semi-polar and cationic surfactants and alkalimetal soap. Normally the composition will contain at least about 15% surfactant (not counting the builder), if used for fabric washing; at least 10% if used for dishwashing, and up to 15% if used for general purpose cleaning. The builders may be selected from alkalimetal phosphates, carbonates, aluminosilicates and other known inorganic or organic builders such as nitrilotriacetate.

The chlorite is preferably selected from chlorites of substituted or unsubstituted ammonium, alkalimetals (for example sodium, potassium or lithium) or alkaline earth metals (for example calcium or magnesium). The preferred material is sodium chlorite.

In use, the composition of the invention is diluted with water before contacting the substrate to a concentration of at least 0.5 g/l in water, usually from about 1 g/l to about 10 g/l, wherein the chlorite concentration will be at a level of below 5 g/l. It is essential that in this diluted state the composition has a pH of at least 6.0, most preferably from about 8.5 to about 11.0, if the composition is used for washing fabrics. The invention is also applicable for the manual cleaning of dishes. In this case the pH of the composition in the diluted state is preferably less than about 8.5 i.e. from 6 to 8.5. Thus it is possible for the composition to have a pH slightly less than about 6.0 before dilution, although normally the composition will have a pH of more than about 7.0 before dilution.

The desired pH may be achieved by the addition of a buffering agent, although where the various components of the composition have suitable natural pH, no buffering agent need be added.

The exposure to ultraviolet light may be achieved by exposing the dispersed composition or the fabrics in contact therewith to daylight or to an artificial source of ultraviolet light. Thus the dispersed composition may be irradiated before contact with the substrate or while the dispersed composition is in contact with the substrate, or alternatively the substrate may be irradiated while in contact with the dispersed composition or thereafter. It is essential that this irradiation occurs before the chlorite is removed, e.g. by rinsing, from the substrate. The ultraviolet light preferably has a component with a wavelength of between about 200 nm and about 400 nm, preferably less than 370 nm.

The intensity of the ultraviolet light, as measured at the fabric surface or at the surface of the liquor is preferably from about 0.01 to about 10.0, more preferably from about 0.05 to about 2.0 $Wm^{-2}nm^{-1}$. Typical bright sunlight has an intensity over most wavelengths of 0.1-0.2 $Wm^{-2}nm^{-1}$. Under these conditions a suitable exposure time is between about 10 minutes and about 10 hours, more preferably between about 30 minutes and about 4 hours, depending on the concentration of the chlorite in the liquor and on the degree of bleaching required. The preferred light intensity can alternatively be expressed as from about $10^{-1}$ to about $10^{-6}$, preferably from about $10^{-2}$ to about $10^{-4}$ Einsteins of energy in the 200 nm to 370 nm wavelength region per liter of liquor.

As the exposure to ultraviolet light causes a breakdown of the chlorite ion in water, it is preferable that the composition is stored before use in a non-transparent container, preferably a UV-opaque container.

The composition may contain one or more ingredients other than those specified above, for example, anti-foaming agents, anti-redeposition agents, perfumes,, perfume carriers, enzymes, organic solvents, other bleaches, bleach precursors and colourants including photoactivated bleaches such as sulphonated zinc phthalocyanine, optical brightening agents, thickeners, fillers, preservatives, dyes, fabric softening agents, dispersion control agents, hydrotropes, anticorrosion agents, structuring agents or electrolytes. Abrasives, such as calcite, may also be present if the composition is used for dishwashing or hard surface cleaning. The composition should, before use, contain substantially no material which in the aqueous liquor will react with and remove the chlorite ions. Thus chlorite ions are known to react with chlorine or chlorine producing materials such as calcium hypochlorite or sodium dichloroisocyanurate to produce chlorine dioxide. Thus, the composition preferably contains, for each part by weight of chlorite, less than 0,4 part, advantageously less than 0.1 part by weight of a material which in aqueous media in the absence of UV-light reacts to a substantial extent with the chlorite ions, that is reacts with at least a major proportion of the chlorite ions.

In order to activate adequate soil removal from the substrate, in addition to bleaching, it is desirable that the ratio of the total weight of the surfactant and builder (when present) to the weight of the chlorite is in excess of 1:1, preferably in excess of about 3.5:1 and ideally in excess of 5.0:1.

The invention will now be illustrated by the following non-limiting examples in which percentages and parts are by weight unless otherwise specified.

In the following Examples 1 and 2, a pyrex cell was partially filled with a treatment liquid, made up as specified in the particular Example. Heavily tea stained cloths were immersed in the treatment liquid. The cell was then placed in the chamber of an ATLAS WEATHEROMETER which had been adjusted to an output to simulate solar radiation both in intensity and energy distribution. The chamber had an initial temperature of about 22° C. After irradiating the cloths from one side only for a selected time the % reflectance at 460 nm was measured using a Zeiss "Elrepho" reflectometer fitted with a UV-filter and the reflectance change, Δ R460*, was determined by comparing the measured reflectance of the treated cloth with that of the same cloth before treatment. The treated cloths were monitored, both those regions of the cloths which were immersed in the treatment liquid and of those regions of the cloths which were suspended above the treatment liquid and which were contacted with the treatment liquid only as a result of capillary action from the immersed regions. Reflectance changes of the front of each cloth were measured.

The totally immersed cloth simulates a method of washing fabrics in a washing machine which incorporates a source emitting a UV-light or bowl washing in daylight, whereas the suspended cloth simulates a rewet sunbleaching operation.

EXAMPLE 1

A fabric washing liquid was used having the following approximate formulation:

| Ingredient | | % by Weight |
|---|---|---|
| Alkyl benzene sulphonate | | 13 |
| Fatty alcohol 3 EO sulphate | | 7 |
| Cocoethanolamine | | 1 |
| Sodium chlorite | | 15 |
| Water and minor ingredients | to | 100 |

A treatment liquid was prepared using 3.5 g/l of this composition. This treatment liquid had a pH between 8.5 and 11.0. The results are set out in the following Table I:

TABLE I

| Chlorite % | Treatment time | Δ R460* Suspended cloth | Δ R460* Immersed cloth |
|---|---|---|---|
| 0 | 1.5 hours | −0.5 | 0.1 |
| 0 | 2.0 hours | 0.3 | 0.6 |
| 15 | 1.5 hours | 0.5 | 1.7 |
| 15 | 2.0 hours | 0.3 | 3.7 |

EXAMPLE 2

Example 1 was repeated except that the cloths were presoaked in the treatment liquid and then suspended in the WEATHEROMETER chamber. The cloths were rewetted with liquor every 30 minutes. The results are set out in the following Table II:

TABLE II

| Chlorite % | Treatment time | Results |
|---|---|---|
| 0 | 1.5 hours | 0.4 |
| 0 | 2.0 hours | 0.3 |
| 15 | 1.5 hours | 0.8 |
| 15 | 2.0 hours | 0.9 |

EXAMPLE 3

The following fabric washing liquid formulations were prepared:

| Ingredient | | % by weight A | | % by weight B |
|---|---|---|---|---|
| $C_{13}$-$C_{15}$-alcohol-7 ethylene oxide/ propylene oxide | | 6.3 | | 6.3 |
| Sodium triphosphate | | 18.1 | | 18.1 |
| Sodium metaborate | | 5.4 | | 5.4 |
| Sodium carboxymethylcellulose | | 0.27 | | 0.27 |
| Fluorescent agent | | 0.09 | | 0.09 |
| Polymer stabiliser | | 0.6 | | 0.6 |
| Sodium chlorite | | — | | 15.0 |
| Water | to | 100.0 | to | 100.0 |

-continued

| Ingredient | % by weight A | B |
|---|---|---|
| pH 1% solution 9.5. | | |

Accelerated storage stability tests carried out with Product B of the invention (1) in transparent bottles in the dark at 37° C., and (2) in transparent bottles unprotected at 23° C., have shown in both cases more than 60% of the original chlorite remains after 50 days' storage.

The actual stability of the composition in non-transparent containers under normal conditions is extremely good.

The photobleaching effectiveness of Product B was tested according to two wash models at the concentration of 14 g/l and was compared with the effectiveness of the control Product A without chlorite.

The first model termed "line dried" corresponds to the situation where tea stained test cloths previously soaked in wash liquor is subsequently exposed (without rinsing) to solar radiation. The second, termed "solution irradiation" showed the effects observable when tea stained test cloth immersed in wash liquor contained in an 0.7 cm pathlength pyrex cell is irradiated with pseudo solar radiation.

The results are shown in the following Table III.

TABLE III

| Product | $ClO_2^-$ g/l in wash liquor | Reflectance ΔR460 Line dried 1 hour | Line dried 2 hours | solution irradiated 1 hours | solution irradiated 2 hours |
|---|---|---|---|---|---|
| A | 0 | −0.8 | 1.9 | 0.0 | 6.0 |
| B | 1.31 | 1.0 | 5.1 | 15.0 | 59.3 |

EXAMPLES 4-7

The following liquid fabric bleaching and cleaning compositions are further examples within the invention:

| Composition (% by weight) | 4 | 5 | 6 | 7 |
|---|---|---|---|---|
| Sodium dodecylbenzenesulphonate | — | 5 | 10 | — |
| Nonionic ethyleneoxide condensate | 6 | 2 | — | 10 |
| Sodium triphosphate | 18 | — | — | — |
| Nitrilotriacetate | — | — | 20 | — |
| Tetrapotassium pyrophosphate | — | — | — | 25 |
| Sodium orthophosphate | — | 20 | — | — |
| Sodium chlorite | 15 | 12 | 20 | 15 |
| Sodium metaborate | 6 | — | — | — |
| Sodium silicate | — | 4 | 5 | 3 |
| Isopropanol | — | — | — | 5 |
| Sodium carboxymethylcellulose | 0.25 | 0.3 | 0.5 | 0.3 |
| Fluorescer | 0.1 | 0.1 | 0.2 | 0.1 |
| Proteolytic enzyme | — | 0.5 | 0.3 | 0.6 |
| Water | | - balance - | | |

EXAMPLE 8

Dishwashing cleaning liquids having the following approximate formulations were prepared and used in the test as described in Examples 1 and 2.

| Ingredient | (8) % | (C) % |
|---|---|---|
| Alkyl benzene sulphonate | 16 | 16 |
| Coconut ethanolamide | 3 | 3 |

-continued

| Ingredient | (8) % | (C) % |
|---|---|---|
| Sodium chlorite | 15 | — |
| Water, preservatives, hydrotropes and minor ingredients | balance | balance. |

Treatment liquids were prepared by dispersing this formulation in water at a concentration of 2.0 g/l. The pH of the treatment liquid containing sodium chlorite was about 7.5. The results are given in the following Table III:

TABLE III

| Chlorite g/l | Treatment Time (hrs) | Δ R460* Immersed Front | Cloth Back |
|---|---|---|---|
| (C) 0 | 2 | 1.0 | 1.0 |
| (8) 0.3 | 2 | 2.9 | 2.2 |

The stain removal of these test pieces is an indication of the stain removal effect of the composition on dishes and also their germ killing effect.

The liquid cleaning composition (8) of the invention can be suitably used for the manual cleaning of dishes.

EXAMPLES 9 AND 10

The following formulations are within the invention and usable for the cleaning of hard surfaces.

EXAMPLE

| Ingredient (% by weight) | 9 | 10 | Control |
|---|---|---|---|
| Sodium chlorite | 18.0 | 9.0 | — |
| $C_{12}$-amine oxide | 5.0 | 3.0 | 3.0 |
| Sodium dodecylsulphate | 5.0 | 2.5 | 2.5 |
| Calcite | — | 50.0 | 50.0 |
| Water | | - balance to 100 - | |

Bleaching Test

Two types of test pieces were used for the bleaching test:

(1) unglazed porcelain tile stained with tea/milk and (2) formica stained with orange juice.

The cleaning test was carried out in two ways, coded "Left" and "Rinsed".

(i) "Left"—some of the test product was poured onto a piece of damp sponge and spread over the test piece. The test piece was then left on the laboratory window-sill for 24 hours. After this time it was rinsed off using tap water and a small brush, and allowed to dry;

(ii) "Rinsed"—The product was spread on the test piece as above and left for 1 minute. It was then removed by wiping with a second piece of damp sponge in a standard pattern. After standing on the window-sill for 24 hours, the test piece was thoroughly rinsed and allowed to dry.

For the tea-stained tile, the whiteness was measured before and after bleaching, and the bleaching efficiency calculated from $$\frac{R_{cleaned} - R_{soiled}}{R_{unstained} - R_{soiled}} \times 100$$

where R is the reflectometer reading.

The bleaching effect on the orange juice stained formica was assessed by eye.

| Results (I) on tea/milk stained tile | % Bleaching efficiency | |
|---|---|---|
| | "Left" | "Rinsed" |
| Example 9 | 71 | 50 |
| Example 10 | 62 | 25 |
| Control | 17 | 21. |

(II) on orange juice stained formica

Both Examples 9 and 10 removed nearly all the stain when left in contact for 24 hours in the "Left" test, whereas the control formula removed very little if any of the stain.

The above results show that a good bleaching effect can be achieved on both tea/milk and orange juice stains provided some of the product is kept in contact with the stain to allow daylight to activate the bleach.

I claim:

1. A liquid-based bleaching and cleaning composition consisting essentially of:

(i) at least about 20% by weight of a liquid base, (ii) about 1% to about 79.9% by weight of a detersive surfactant with or without a detergency builder; and (iii) about 0.1% to about 40% by weight of a chlorite whereby said composition yields a pH of at least 6.0 when dispersed in water at a concentration of about 0.5 g/l and provides a bleaching effect when exposed to a source of ultraviolet light.

2. A composition according to claim 1, wherein the surfactant is selected from soaps, anionic, cationic, zwitterionic, semi-polar, amphoteric and nonionic surfactants and mixtures thereof.

3. A composition according to claim 1, wherein the chlorite is selected from chlorites of alkalimetals, alkaline earth metals and substituted or unsubstituted ammonium.

4. A composition according to claim 3, wherein the chlorite is sodium chlorite.

5. A composition according to claim 1, wherein the chlorite is present in an amount of about 0.5 to about 40% by weight of the composition.

6. A composition in accordance with claim 1, wherein the composition contains, for each party by weight of the chlorite, less than about 0.4 parts by weight of a material which in aqueous media in the absence of ultraviolet light reacts to a substantial extent with the chlorite ions.

7. A composition according to claim 1, wherein the composition further contains any one or more of builders, in an amount of up to about 40% by weight of the composition.

8. A composition according to claim 1, wherein the ratio of surfactant, with or without builder, to the chlorite is in excess of 1:1.

9. A composition according to claim 1, wherein the pH of said composition is from 8.5–11 when dispersed in water at concentration of about 0.5 g/l.

10. A composition according to claim 1, wherein the pH is from 6–8.5 when said composition is dispersed in water at a concentration of about 0.5 g/l.

11. A composition according to claim 1, wherein said ultraviolet light has a component with a wavelength of about 200 nm to about 400 nm.

12. A composition according to claim 1, wherein the wavelength of said ultraviolet light is less than 370 nm.

13. A composition according to claim 1, wherein the intensity of said ultraviolet light is about 0.1 to about 10.0 $Wm^{-2}\ nm^{-1}$.

14. A composition according to claim 1, wherein the intensity of said ultraviolet light is from about $10^{-1}$ to about $10^{-6}$ Einsteins of energy per liter of said composition.

15. A method of bleaching and cleaning fabrics comprising the steps of:

(i) preparing a treatment liquid comprising (a) at least about 20% by weight of a liquid base;

(b) about 1% to about 79.9% by weight of a detersive surfactant with or without a detergency builder; and (c) about 0.1% to about 40% by weight of a chlorite;

(ii) contacting said fabric with said treatment liquid; and then (iii) exposing said fabric contacted with said treatment liquid to a source of ultraviolet light whereby a bleaching and cleaning effect is obtained.

16. A method of bleaching and cleaning fabrics according to claim 1, wherein the pH of said treatment liquid is at least 6.0 when dispersed in water at a concentration of about 0.5 g/l.

* * * * *

UNITED STATES PATENT AND TRADEMARK OFFICE

CERTIFICATE OF CORRECTION

PATENT NO. : 4,332,691

DATED : June 1, 1982

INVENTOR(S) : Stuart W. Beavan

It is certified that error appears in the above—identified patent and that said Letters Patent is hereby corrected as shown below:

Col. 8, line 46, change "claim 1" to read --claim 15--.

Signed and Sealed this

Third Day of May 1983

[SEAL]

*Attest:*

GERALD J. MOSSINGHOFF

*Attesting Officer*

*Commissioner of Patents and Trademarks*